US006040747A

United States Patent [19]

Krasser et al.

[11] Patent Number: 6,040,747

[45] Date of Patent: Mar. 21, 2000

[54] OVERCURRENT CIRCUIT BREAKER

[75] Inventors: Fritz Krasser; Franz Winkler, both of Altdorf, Germany

[73] Assignee: Ellenberger & Poensgen GmbH, Altdorf, Germany

[21] Appl. No.: 08/925,045

[22] Filed: Sep. 8, 1997

[30] Foreign Application Priority Data

| | | | |
|---|---|---|---|
| Sep. 7, 1996 | [DE] | Germany | 296 15 644 |
| Sep. 10, 1996 | [DE] | Germany | 296 15 761 |
| Nov. 19, 1996 | [DE] | Germany | 196 47 716 |

[51] Int. Cl.[7] ..... H01H 75/12

[52] U.S. Cl. ..... 335/35; 337/66

[58] Field of Search ..... 335/23–25, 35, 335/43, 132, 202; 337/66, 67, 68, 69, 70, 71, 72, 73, 74, 75, 57, 62, 34

[56] References Cited

U.S. PATENT DOCUMENTS

| | | | |
|---|---|---|---|
| 3,456,225 | 7/1969 | Ellenberger . | |
| 4,463,403 | 7/1984 | Fasano | 361/124 |
| 4,990,882 | 2/1991 | Peter | 337/66 |

FOREIGN PATENT DOCUMENTS 579823 9/1976 Switzerland .

*Primary Examiner*—Lincoln Donovan
*Attorney, Agent, or Firm*—Venable; George H. Spencer; Catherine M. Voorhees

[57] ABSTRACT

An overcurrent circuit breaker arranged inside an approximately cube-shaped, two-part insulating housing, having a chassis section and a locking section. Located between the parallel side walls of the housing sections is a switchgear with a contact bridge, the movement of which is guided parallel to the side walls and which extends in essentially longitudinal direction at a right angle to the side walls and while in the on position between two fixed contacts that are fastened inside the housing and are positioned on both sides of the movement plane for the switchgear. The fixed contacts are flat pieces akin to a knife blade and fit against the side walls and, respectively, form a contact point with their narrow, knifeblade type edges facing the contact bridge. With their rear sides opposite the contact points, the fixed contacts fit against a flank wall of housing. As a result of this, the fixed contacts are positioned in an especially space-saving manner in the corners of housing.

27 Claims, 10 Drawing Sheets

FIG 2
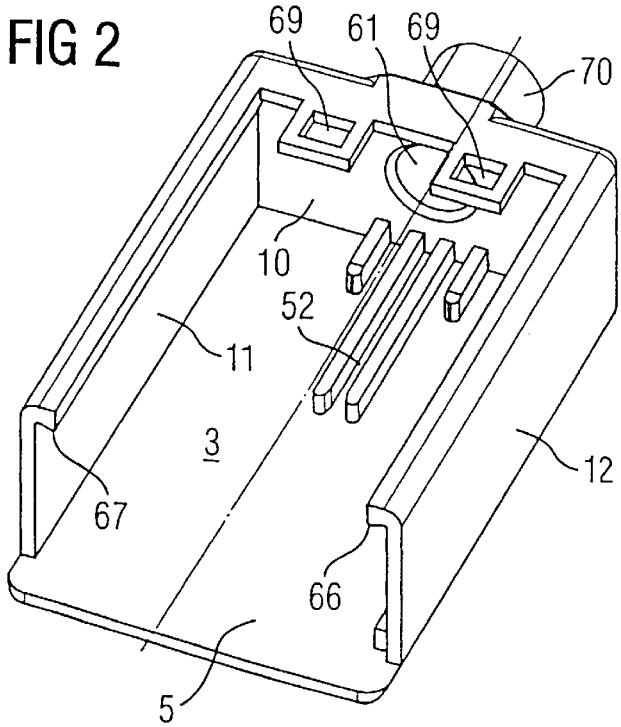
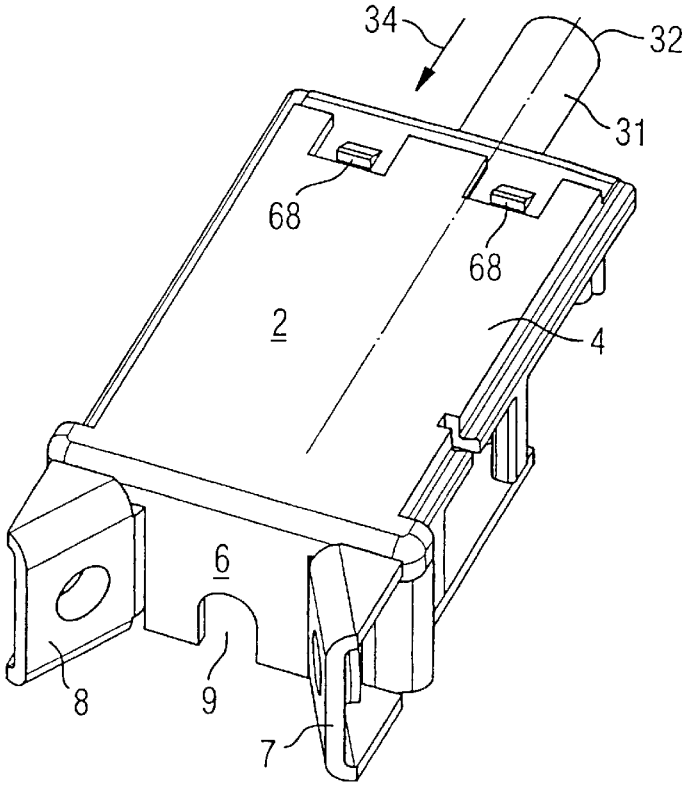
FIG 3

ON POSITION
32
31
10
11
51
62
39
44
20
12
64
42
37
44
47
38
60
30
54
56
58
53
14
28
33
22
23
21
59
77
26
24
6
25
6
63
7
8

OVERCURRENT CIRCUIT BREAKER

CROSS-REFERENCE TO RELATED APPLICATIONS

This application claims the priority of German applications No. 29615644.2 filed Sep. 7, 1996, No. 29615761.9 filed Sep. 10, 1996 and No. 19647716.6 filed Nov. 19, 1996, all of which are incorporated herein by reference.

BACKGROUND OF THE INVENTION

The present invention relates to an overcurrent circuit breaker with thermal release of the type shown in U.S. Pat. No. 3,456,225 and its counterpart German Patent No. 1,588,146.

SUMMARY OF THE INVENTION

It is the object of the invention to improve a switch of the aforementioned type in such a way that it can be produced cost-effectively and that a narrow, economical design with respect to space is possible, even lateral to its wall surfaces. In particular, the invention relates to a circuit breaker able to handle high switching currents in excess of 50 A, without the larger line cross sections, which are suitable for high current intensities, having an adverse effect on the solution for the above-mentioned object. This object is solved by providing the circuit breaker that is described in detail below, which allows for an extremely economical positioning with respect to space of the fixed contacts inside the housing corners and still have a large air space between them. Their knife-edge type effectiveness relative to the contact bridge ensures an excellent contacting.

The exact positioning of the fixed contacts with respect to their longitudinal direction is made easier, and permits in this connection a particularly space-saving positioning, staggered in the direction of the longitudinal switch axis, of the two fixed contacts and their base elements. This makes possible to adhere to a narrow design for the switch or the switch housing. Also, a way is provided to facilitate the installation of the switch while ensuring the position accuracy of the two fixed contacts.

The housing is composed of only two sections, namely, of two housing shells made of an insulating material and facing each other with their open sides, which are designed for the storage and/or guidance of not only the fixed contacts, but also the movable parts of the switch kinematics, namely the chassis section and the locking section. Both sections contain, respectively, one of the two side walls that are essentially parallel to each other. The switch housing has approximately cubic outer contours, and its side walls, which are approximately parallel to each other, form the contact surfaces to the neighboring switch, if several switches are lined up.

In addition to forming one of the aforementioned wall surfaces, the chassis section also forms a front, while the locking section comprises the two flank or narrow side walls in addition to the other front. For the assembly, the functional parts, which may be pre-assembled to form structural components, are simply placed onto the inside of the chassis section and are inserted there between wall projections formed during the one-piece injection molding of the chassis section, such that their position is secured. The chassis section which is thus provided with the function elements in a secured position, is inserted like a drawer in longitudinal direction of the switch into the locking section until the sections are mutually locked together.

According to another feature of the present invention long leakage paths are created for the switching voltage despite the intended narrow design for the switch. This counteracts the formation of an electric arc.

BRIEF DESCRIPTION OF THE DRAWINGS

FIG. 2 is a perspective inside view of a housing section, which is referred to as "locking section;"

FIG. 3 is an outside view of the other housing section referred to as "chassis section" with the switch rod handle, which projects from it when all functional element are fully assembled, wherein the chassis section is in the starting position, ready for assembly, opposite the locking section according to FIG. 2;

DETAILED DESCRIPTION OF THE PREFERRED EMBODIMENT

Figure 1:
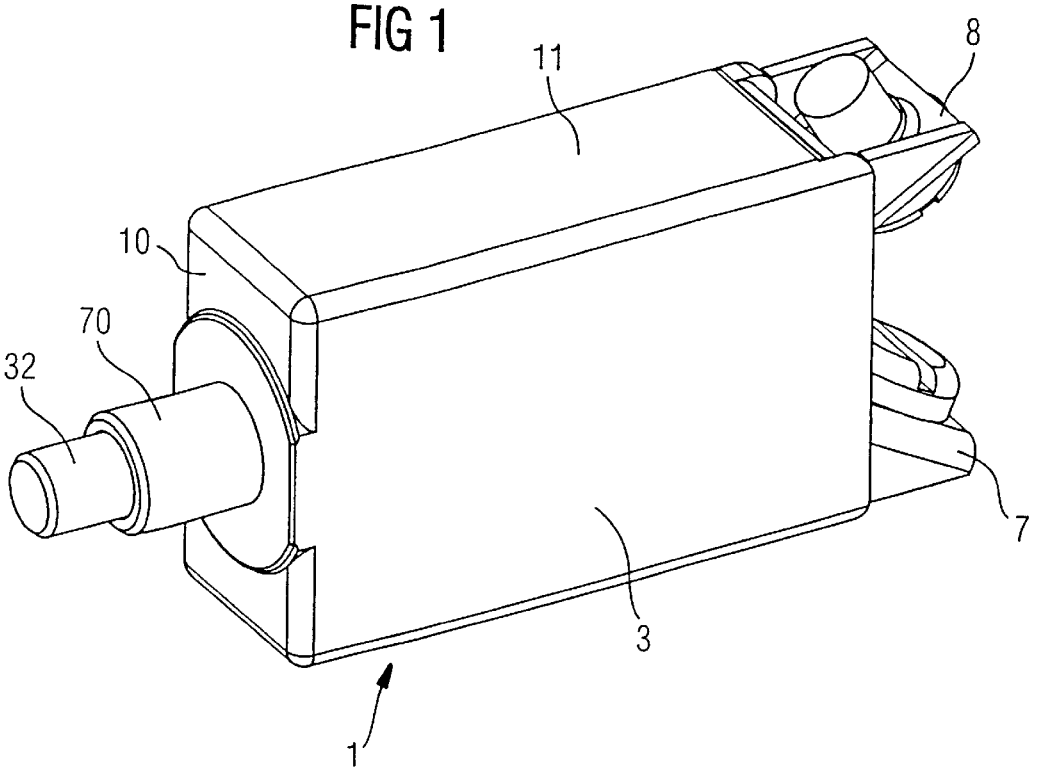
FIG. 1 is a perspective view from the outside of the completely mounted switch.

The switch according to the present invention comprises a flat, box-shaped housing 1 of insulating material, which essentially has the outer contours of a cube. The two-part housing consists of the chassis section 2 and the locking section 3 with side walls 4 or 5, which are positioned approximately parallel to each other for the purpose of stringing them together to save space. With respect to the remaining outside walls of the switch, the chassis section 2 contains the first front wall 6 with bushings for the contact connections 7, 8 and a through hole 9 for the below-described adjustment of the bimetal 38. Concerning the housing walls effective toward the outside, the locking section 3, on the other hand, contains in addition to the side wall 5 also the second front wall 10 on the actuation side and the two flank walls 11, 12 of the housing 1.

Located inside the housing 1 is the switchgear with a movement plane that extends approximately in the center between the side walls 4, 5. The switchgear functions to guide the movement of contact bridge 13, which bridges the space between the fixed contacts 14, 15 in the on state and connects the fixed contacts 14, 15 with its contact ends 71, 72, such that they are electrically conducting.

The fixed contacts 14, 15 that are positioned in the current path between the contact connection 7 (current input) and the contact connection 8 (current output) are flat elements, e.g. stamped sheet metal parts. Their surfaces extend somewhat like a knife blade parallel to the side walls 4, 5 and form respectively one blade-like contact point 16 or 17 with their narrow, knife-blade type edges facing the contact bridge 13. With their rear narrow edges 18, 19, located opposite the contact points 16, 17, the fixed contacts 14, 15 fit against the flank wall 12 of the housing 1. They extend, in the direction of their longitudinal axis 73, from the first housing front wall 6 into the flank spaces beside the movement plane for contact bridge support 20 of the switchgear. When fully assembled, fixed contact 15 directly rests against side wall 4 of chassis section 2, and fixed contact 14 rests against side wall 5 of locking section 3. In their base regions, the fixed contacts 14, 15 are bent at an approximately right angle relative to their area extension, in such a way that their base elements 21, 22 extend as connecting regions to the contact connections 7, 8 at an essentially right angle to the side walls 4, 5 and approximately parallel to the front walls 6, 10 of the housing 1. They are positioned or plugged into the spaces between the holding projections 23–26 that project from the side wall 4 of housing section 2 toward the housing inside. For this, the base elements 21, 22 form an upper U-shaped leg of a U-shaped pedestal part 75, 76 of fixed contacts 14, 15, which faces the contact points 16, 17.

Figure 4:
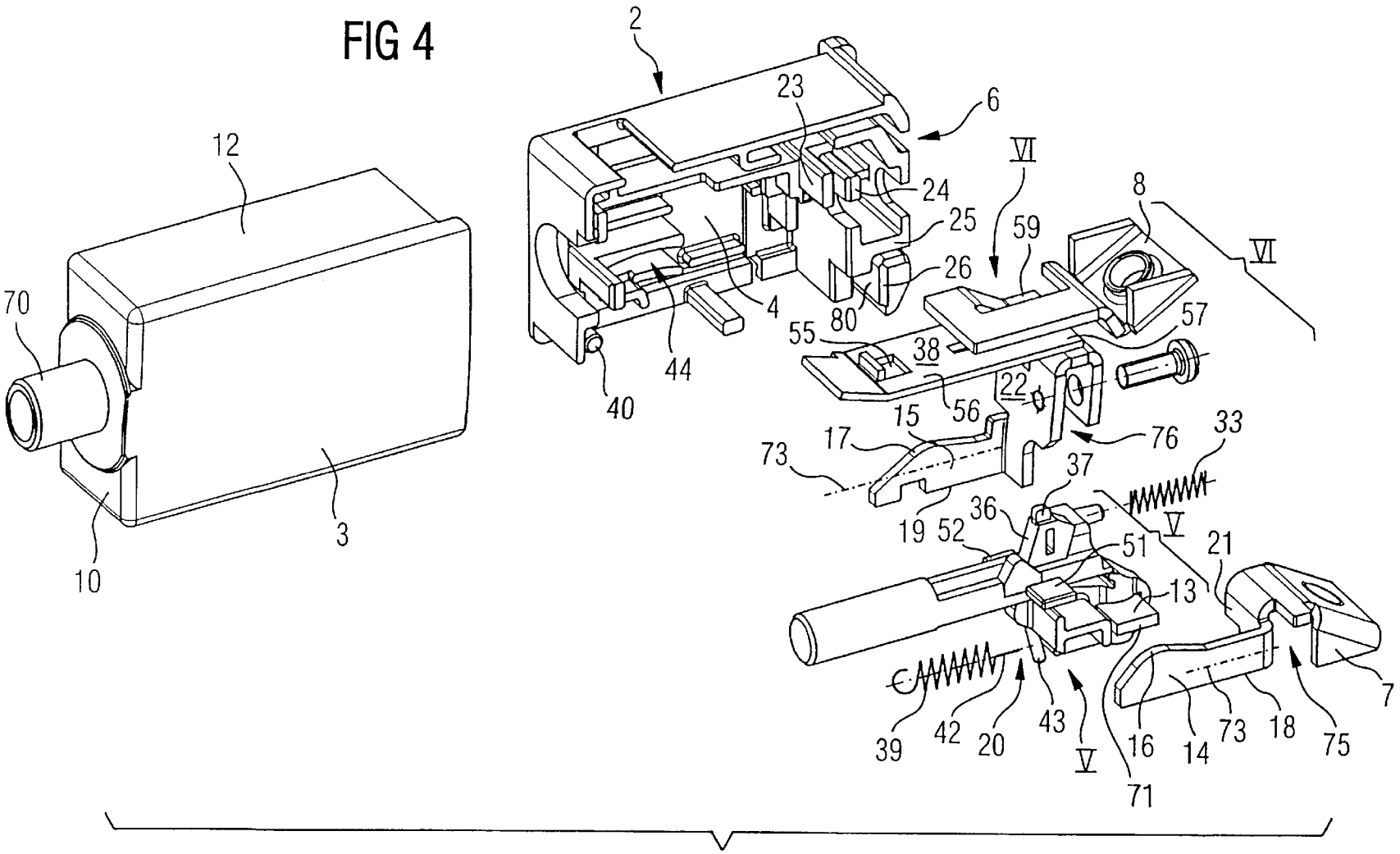
FIG. 4 is an enlarged view of all individual elements of the switch, mutually coordinated with respect to space.
Figure 6:
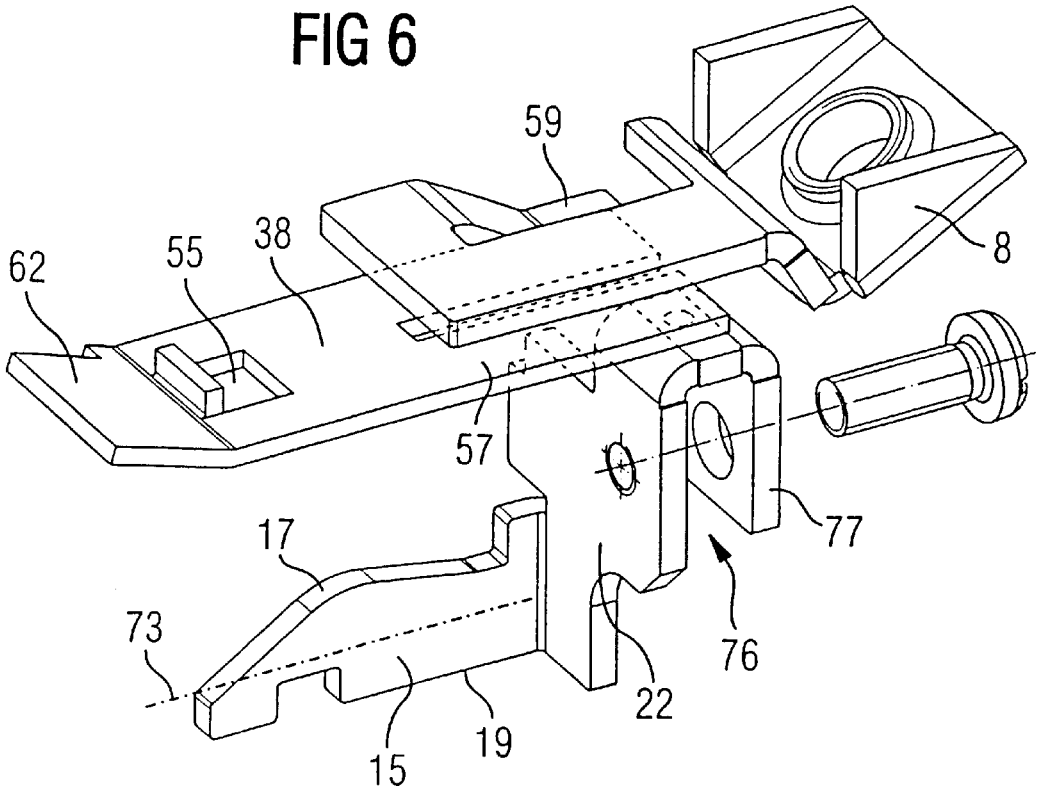
FIG. 6 is an enlarged view of the component VI in FIG. 4, comprising the fixed contact assigned to the current output, the bimetal and a contact connection.
Figure 7:
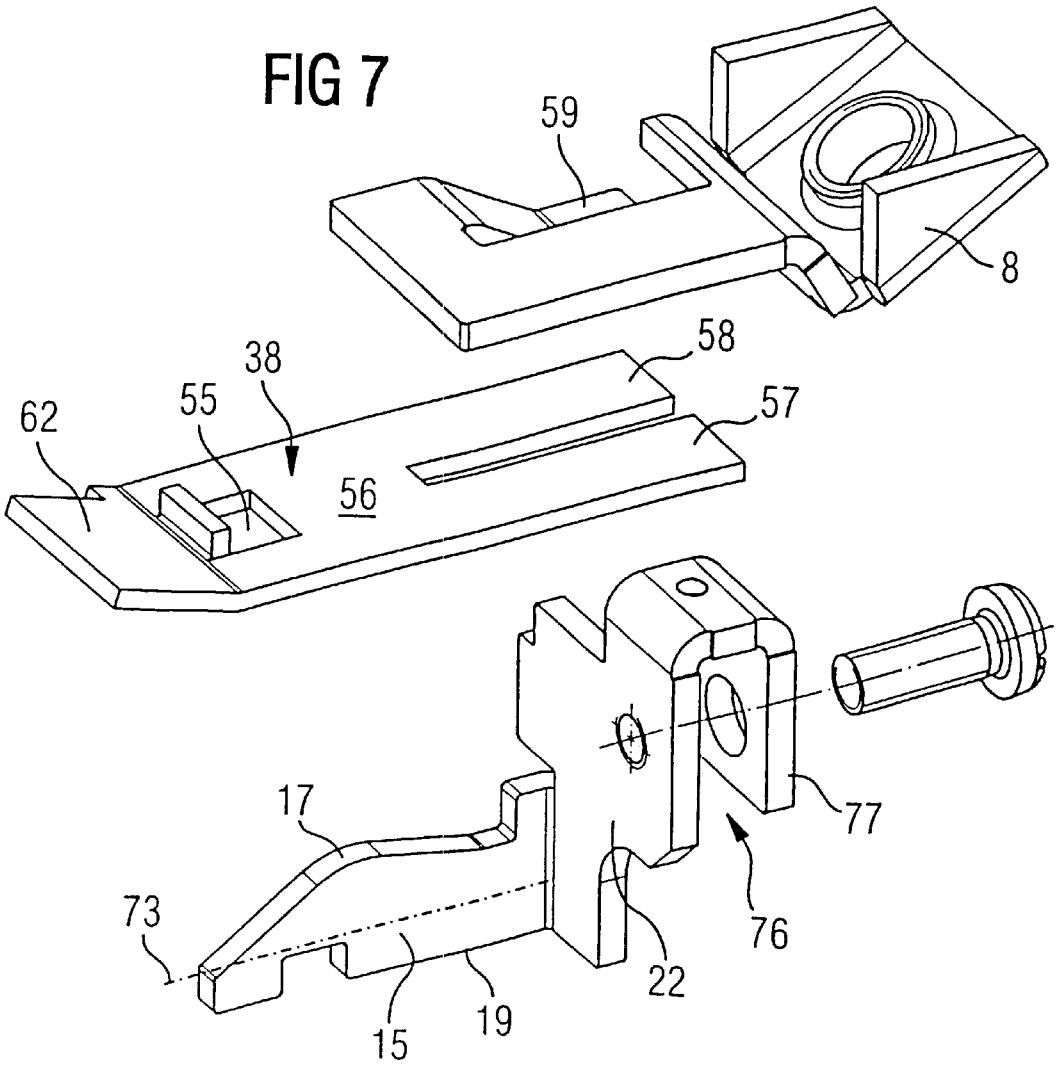
FIG. 7 is an enlarged view of the individual elements of the fixed-contact bimetal component according to FIG. 6.
Figure 8:
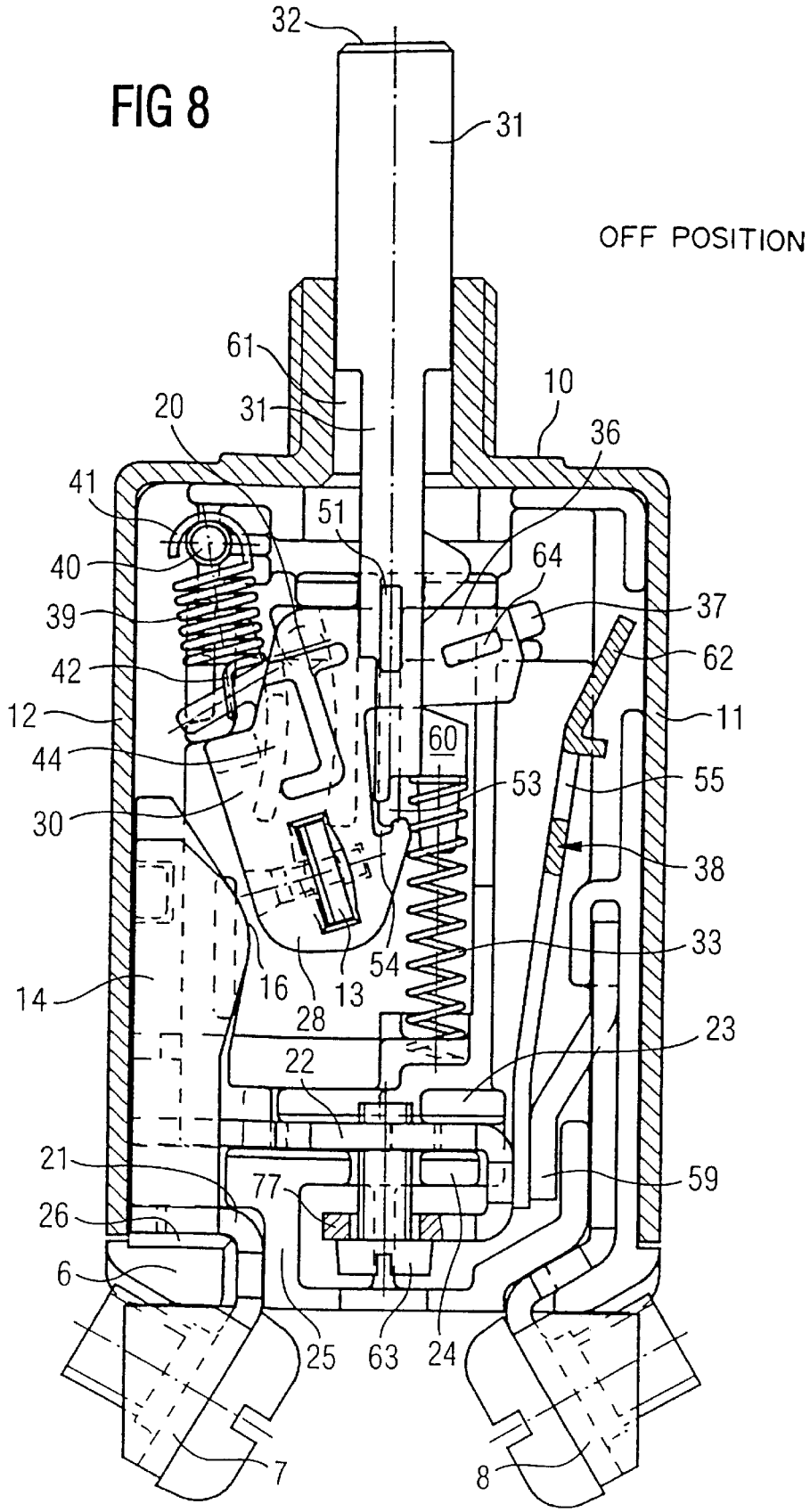
FIG. 8 is a cross section through the switch with a cutting plane that extends approximately through the movement plane for the individual elements of its switchgear while in the off position.
Figure 9:
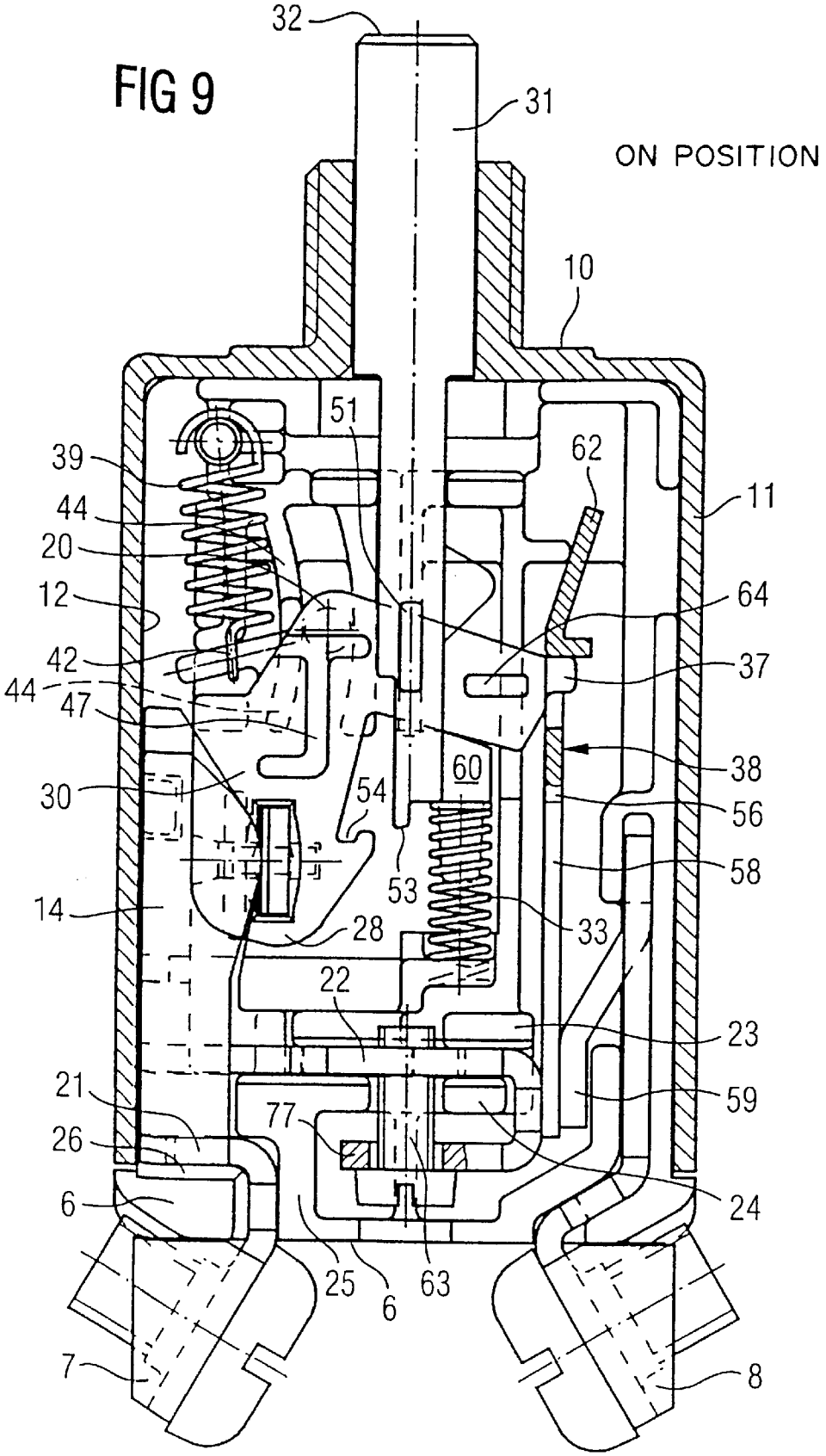
FIG. 9 is a sectional view corresponding to FIG. 8 in the on position.

The pedestal part 75 of fixed contact 14 embraces the holding projection 26 that is formed by a segment of the front wall 6 of chassis section 2. In this case, the contact connection 7 that is formed as one piece with the fixed contact 14 and is located outside of the housing forms with its upper edge the lower leg U (FIGS. 4, 8, 9). The pedestal part 76 of the other fixed contact 15 has a U-shaped form with the base element 22 forming the upper U-shaped leg and the lower U-shaped leg 77 (FIGS. 6, 7) forming the passage for the adjustment screw 63. The fixed contacts 14, 15 are formed as one piece with their base elements 21, 22 and the fixed contact 14 is additionally formed as one piece with its contact connection 7.

Figure 11:
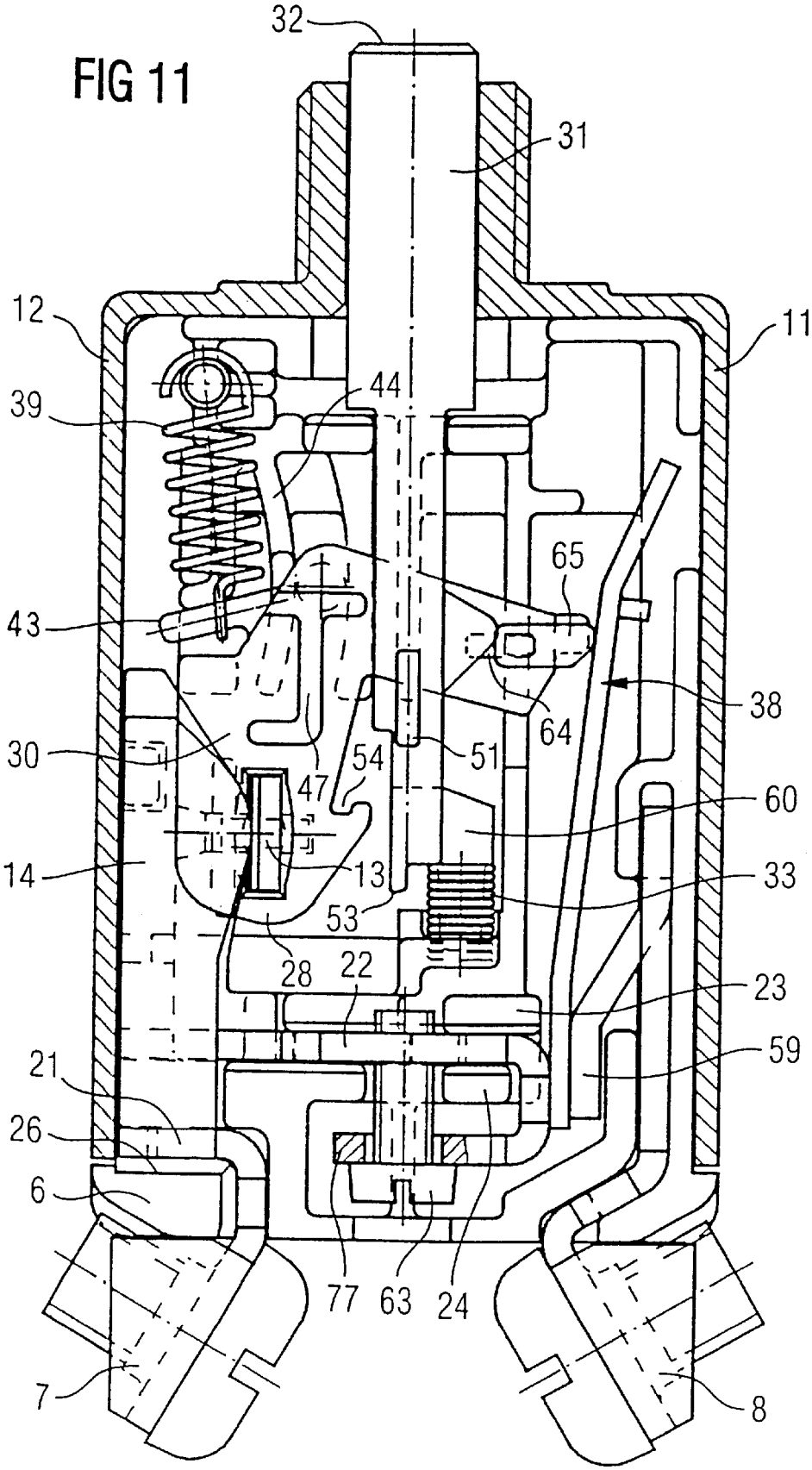
FIG. 11 is an illustration corresponding to FIG. 9, with a switchgear that is turned manually to the starting position where it is ready for release.

While their contact points 16, 17 are positioned at approximately the same height, the fixed contacts 14, 15 have a varied length (FIG. 4). Once installed, their base elements 21, 22 are consequently at different distances from the first front wall 6. Base element 22 extends between holding projections 23 and 24, and base element 21 abuts stop face 80 of holding projection 26 (FIG. 4). The desired narrow design is thus made possible in that the two fixed contacts 14, 15 are nested into each other when they are installed. As a result of this, the two base elements 75, 76 in the installed position are therefore arranged staggered, one behind the other, or below each other in longitudinal direction of the switch axis (FIGS. 8, 9 and 11).

The contact bridge support 20 is essentially a flat element that extends in the center, at a distance between the side walls 4, 5 with its center plane approximately parallel to the side walls 4, 5. It is manufactured as one piece from an insulating material. The contact bridge support 20 carries the contact bridge 13 on its side facing the fixed contacts 14, 15. The contact bridge support 20 has an angle-shaped contour and thus has a vertical leg 27 on the side of fixed contacts 14, 15, which projects toward the contact connections 7, 8 or the housing front wall 6, and which is penetrated in the region of its free end 28 by the contact bridge 13 that is aligned approximately perpendicular to the wall surfaces 4, 5. The contact bridge 13 is a metallic, mostly flat sheet metal piece, which can also be provided with contact plates, and forms a counter contact to the fixed contacts 16, 17 with its two ends that project over the contact bridge support 20 in the direction of its longitudinal axis 74. It is inserted into a slot 29 of contact bridge support 20 that extends approximately perpendicular through the vertical leg 27. The contact bridge 13 is inserted in such a way that it can be deflected slightly toward both sides, around the axis formed by the slot 29 sides from its approximately right-angle position relative to the center of the longitudinal plane of the contact bridge support 20. This ensures a good contact.

In the on position, the contact bridge support 20, which is injection-molded as one piece from insulating material, projects into the space between the two fixed contacts 14, 15 with a flat element 30 that is aligned approximately parallel to the fixed contacts 14, 15 and functions like a parallel wall screen. The fixed contacts 14, 15 are consequently screened from each other and the arc gap between them is clearly increased.

A switch rod 31 of insulating material can also be moved in the same way as the contact bridge support 20 in longitudinal direction in the movement plane for the switchgear kinematics that extends between the fixed contacts 14, 15 and parallel to the side walls 4, 5. The longitudinal displacement is caused by a manual admitting of the actuation end 32 of the switch rod 31 that projects from the housing. The actuation direction 34 is counter to the pressure direction for a release spring 33, which is displaced in the movement plane toward the side facing away from the fixed contacts 14, 15 and the vertical leg 27 of contact bridge support 20 and is supported on the one hand on the lower end of switch rod 31, the contact connection side, and on the other hand on the housing 1 itself. It is consequently prestressed by applying pressure to the switch rod 31 in the actuation direction 34.

A longitudinal groove 35 runs through the switch rod 31, approximately through the center of the longitudinal plane for the switchgear kinematics. It serves as sliding guide for the horizontal leg 36 of the contact bridge support 20, which projects through the longitudinal groove 35 and extends from the fixed contact side or the side of the left flank wall 12 (FIGS. 8, 9 and 11) of housing 1 into the other housing region that faces the right flank wall 11 and carries on its end the interlocking cam 37 for locking together the contact bridge support 20 and the overcurrent release described in more detail below, namely the bimetal 38. On the fixed contact 14, 15 side, the contact bridge support 20 is admitted by a tension spring 39 with pressure in upward direction, onto the front wall 10 with push button of the switch housing 1. On its upper end facing the front wall, the tension spring 39 is threaded by means of a spring eye 41 onto a holding protrusion 40 that projects upward from the wall surface 4 of chassis section 2. For the position where the chassis section 2 is inserted into the locking section 3, described in more detail below, the holding protrusion 40 extends with its free end to the side wall 5 of locking section 3, so that once it is assembled, the tension spring 39 is fastened undetachable to the chassis section 2.

The switch rod 31 and the contact bridge support 20 are aligned and guided movably with support guides on the side walls 4, 5 of the housing 1. The housing sections 2, 3 or the side walls 4, 5 associated with them therefore ensure the alignment on the one hand and, on the other hand, also the mobility of switch rod 31 and contact bridge support 20 in the movement plane within the housing 1 itself.

In the region of its angle vertex 49, the tension spring 39 is hinged with its lower end 42 to the contact bridge support 20 located on the side opposite the interlocking cam 37. A one-piece holding finger 43 is attached there, onto which the tension spring 39 is placed with its lower end 42. The tension spring 39 progresses with its longitudinal axis along the fixed contact side and parallel to the center of the longitudinal plane for the switching kinematics, in a region adjacent to the side wall 4 of chassis section 2. Insofar, it is always off-center. This off-center position of tension spring 39 on the one hand has a causal connection in that the contact bridge support 20 is guided only along the side wall 4 of the chassis section 2 inside a turning and sliding joint guide that extends essentially in the longitudinal direction of the switch rod. The turning and sliding joint guide is formed by a guide groove 44 on the side wall 4 of chassis section 2, which essentially runs parallel to the switch rod 31, and a pivot 45 on the vertex 49 of contact bridge support 20, which is guided movably therein, approximately perpendicular to the movement plane for the switch gear kinematics. The guide groove 44 extends over a circular-segment shaped course in longitudinal direction, with a curvature bulge facing the switch rod 31. This course for the guide groove favors the engagement of switch 31 in contact bridge support 20 in a way that is described in more detail later on. The tension spring also generates the contact pressure on the contact points 16, 17 by admitting the contact bridge support such that it swivels around its pivot 45.

The pivot 45 does not function only as a guide in the manner of a sliding block to ensure a specific movement curve of the contact bridge support 20 relative to the housing 1. Rather, its front surface 46 is also designed to fit against the side wall 4 of chassis section 2. This contact, together with the fact that the front surface 47 of bracket 48 that is formed onto the other flank side of the contact bridge support 20 fits against the side wall 5 of locking section 3 of the housing results in the alignment and parallel guidance of the contact bridge support 20 between the two side walls 4, 5 of the housing 1. The fin-shaped bracket 48 extends from the vertex region 20*a* between the two legs 27, 36 of contact bridge support 20 into the region of slot 29 for holding the contact bridge 13, which is fixed with a pin 49 that projects through the through hole 50 in contact bridge 13 and into the insertion hole 78 of contact bridge support 20. The cross-sectional shape of the bracket 48 is that of a T or an approximate double T carrier.

In the region where the actuation end 32 of switch rod 31 extends through the second front wall 10 of housing 1 and inside the housing, the switch rod can be moved longitudinally inside a groove in switching or actuation direction 34 by two guide shoes 52 on the side wall 5, which project diametrically, approximately perpendicular to the movement plane for the switchgear kinematics. The grooves are formed onto the inside of the side walls 4, 5 on chassis section 2 and locking section 3. The groove 52 that is coordinated with the locking section 3 can be seen clearly in FIG. 2. Guide shoe 51 extends from switch rod 31 and is inserted in the groove formed by guide shoes 52 when assembled. The guide shoes 51, 52 are arranged at the height of longitudinal groove 35 for switch rod 31.

A gripping fin 53 is formed onto the lower end of the switch rod 31, which can be fitted as carrier onto the inside of the vertical leg 27 of contact bridge support 20. It serves to grip a carrier notch 54 on the inside and lower end 28 of the vertical leg 27 of contact bridge support 20 if the switch rod 31 is pushed in the actuation direction 34. In the open contact position (FIG. 8), the carrier notch 54 projects into the movement path for the gripping fin 53 of switch rod 31. The above-described curvature bulge of guide groove 44 that projects in the direction of the switch rod 31 (FIG. 4) is provided in order to bring the contact bridge support 20 into a position that favors the engagement of the gripping fin 53 into the carrier notch 54. For the most part, this curvature bulge is shown as dashed line in the course for the guide groove 44 that is shown in FIGS. 8 and 9.

The overcurrent release comprises a bimetal 38 that is approximately parallel to the switch rod 31 and has a detent opening 55 at the pivoting end, which is designed to allow the interlocking cam 37 of contact bridge support 20 to engage. The bimetal 38 is bent into a U shape and points upward (FIG. 7) with the connecting web 56 between the two U-shaped legs 57, 58. The one U-shaped leg 57 is connected tightly, in particular welded, to the base element 22 or the pedestal part 76 of the fixed contact 14 assigned to the current output. The other U-shaped leg 58 is welded with its end to the contact connection 8 that is assigned to the current output. Both U-shaped legs 57, 58 form an approximately right-angle plane to the wall surfaces 4, 5. The welded connection is planned in the region of leg end 59 of the one-piece contact connection 8 (FIG. 7). Under the effects of an overcurrent, the U-shaped arc or the U-shaped connecting web 56 of the bimetal 38 bends outward in clockwise direction relative to the places where U-shaped legs 57, 58 are clamped in (FIG. 8), meaning in the direction away from the contact bridge support 20. The interlocking cam 37 of the contact bridge support 20 is released as a result.

Figure 5:
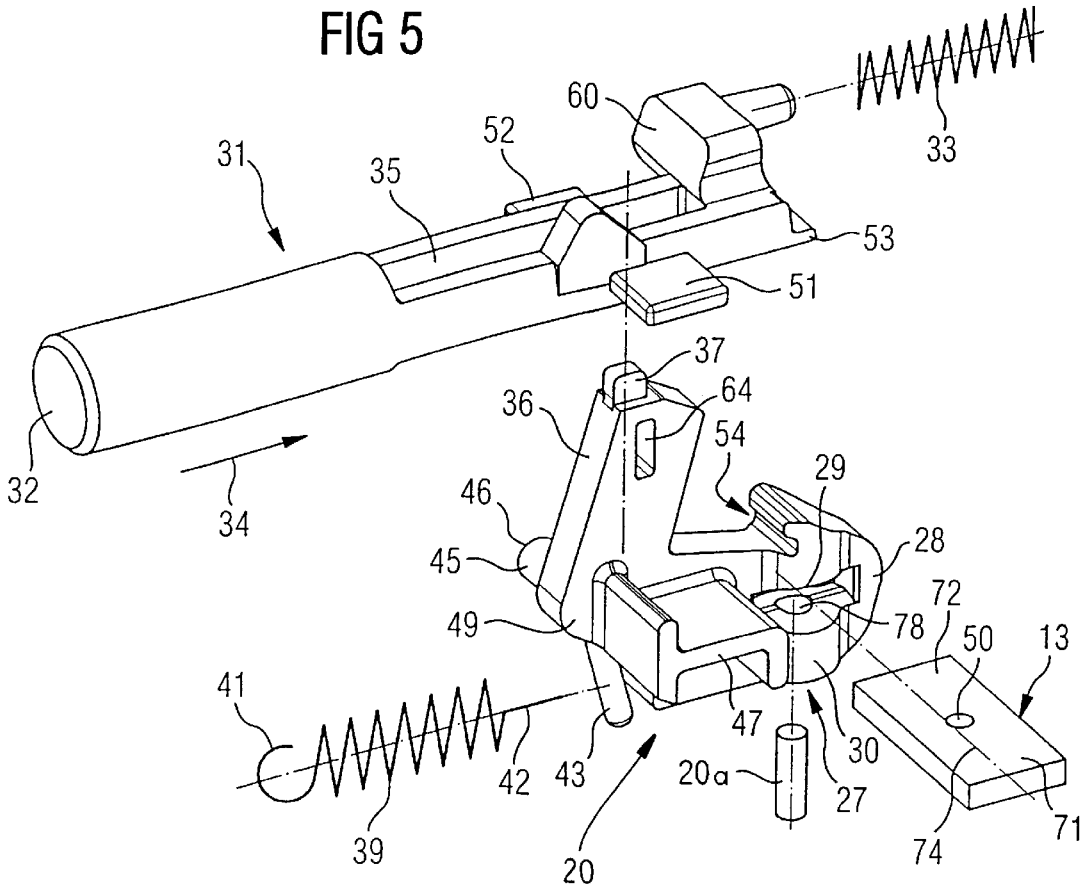
FIG. 5 is an enlarged view of the individual elements that form the component V according to FIG. 4 in a preassembly state, meaning essentially the contact bridge support and the switch rod.

The switching on and the overcurrent release are described in particular with the aid of FIGS. 8 and 9: in FIG. 8, the switch is in the off position. The contact bridge support 20 on the one hand is raised by the release spring 33 and pulled counterclockwise around the pivot 45 and, on the other hand, it is pulled by the tension spring 39 into its off position. To be sure, the release spring 33 acts upon the switch rod 31. However, the switch rod 31 indirectly carries the contact bridge support 20 along in upward direction via the off-center anvil foot 60 that forms the lower length limitation of the longitudinal groove 35. The contact bridge support 20 with its horizontal leg 36 rests on the anvil foot 60. The admitting of the contact bridge support 20 by the release spring 33 in the region of the horizontal leg 36 also causes a pivoting of the contact bridge support 20 in counterclockwise direction around the pivot 45 (FIG. 5, 10). As a result, this pivot is pushed upward inside the curved guide groove 44 while at the same time being pivoted counterclockwise. Finally, the guide groove 44 acts like a turning and sliding joint, relative to the pivot 45. FIG. 8 shows the opened position, in which the contact bridge 13 maintains a clear distance from the two contact points 16, 17 of the fixed contacts 14, 15. In this position, the contact bridge 13 is screened relative to the fixed contacts 14, 15 by the flat piece 30 that projects in the direction of the fixed contacts 14, 15. As a result of the pivoting position of contact bridge support 20 that is inclined in counterclockwise direction around the pivot 45, together with the circular-arc type curved course of the guide groove 44, the carrier notch 54 of vertical leg 27 of the contact carrier bridge 20 projects into the movement path of the gripping fin 53, which is formed onto the lower end of switch rod 31. In this switched-off position, the switch rod 31 with its actuation end 32 projects particularly far from the housing bushing 61, and the length of the actuation end 32 that is projecting also indicates the "off state" to the outside.

For the switching on, the switch rod 31 is admitted in actuation direction 34. The gripping fin 53 at the lower end of the switch rod 31 grips the contact bridge support 20 by fitting itself into the carrier notch 54 and moves the contact bridge support 20 downward. The transfer of the pushing movement from switch rod 31 to the contact bridge support 20 takes place through admitting of the horizontal leg 36 of the contact bridge support 20 by the upper end of the longitudinal groove 35 in the switch rod 31. The tension spring 39 is tensioned and the release spring 33 is compressed by the pressure movement of switch rod 31. Owing to the fact that the contact bridge support 20 is admitted off-center by the tension of tension spring 39, relative to pivot 45, the downward movement of the contact bridge support 20 that is guided by pivot 45 in the guide groove 44 occurs as a result of pivoting clockwise around the axis of pivot 45. The tension spring 39 supports this clockwise, rotational movement of contact bridge support 20 and, above all, causes the necessary contact pressure. In the on position shown in FIG. 9, the interlocking cam 37 at the outer end of the horizontal leg 36 of contact bridge support 20 engages in the detent opening 55 at the upper end of bimetal 38. The bimetal 38 has an extension 62 above the detent opening 55, which is bent toward the outside and into which the interlocking cam 37 bumps prior to falling into the detent opening 55. During a further pushing of the switch rod 31 and the displacement downward of contact bridge support 20, which is caused by this, the bimetal 38 is bent outward even more in clockwise direction, until the interlocking cam 37 overlaps with the detent opening 55 and the bimetal 38 springs back in clockwise direction owing to its inherent restoring force, thereby engaging into the interlocking cam 37.

In the on position, the actuation end 32 of switch rod 31 clearly projects less far over the housing bushing 61 toward the outside and signals the "on position" to the outside.

Due to an overcurrent in the current path between the contact connections 7, 8, the bimetal 38 is bent outward in clockwise direction, relative to its lower clamp-in leg 57. Its detent opening 55 releases the interlocking cam 37, which release activates the spring forces of release spring 33 and tension spring 39 in the manner as described above. The contact bridge support 20 returns automatically to its opened position according to FIG. 8 as a result of this double spring effect. It returns to the upper stop position at housing 1, as shown in FIG. 8.

The switch rod 31 is designed such that even if it is kept in the switched-on position and with simultaneous admitting of the device with overcurrent, the device is released and the contact bridge support 20 can move to the off position (trip-free release).

The adjustment screw 63 is accessible from the outside between the two contact connections 7, 8 and the through hole 9 in front wall 6 of housing 1. The adjustment screw 63 acts upon the base element 22 of the fixed contact 15 in the current leakage range and thus causes the adjustment movement of the bimetal 38.

Figure 10:
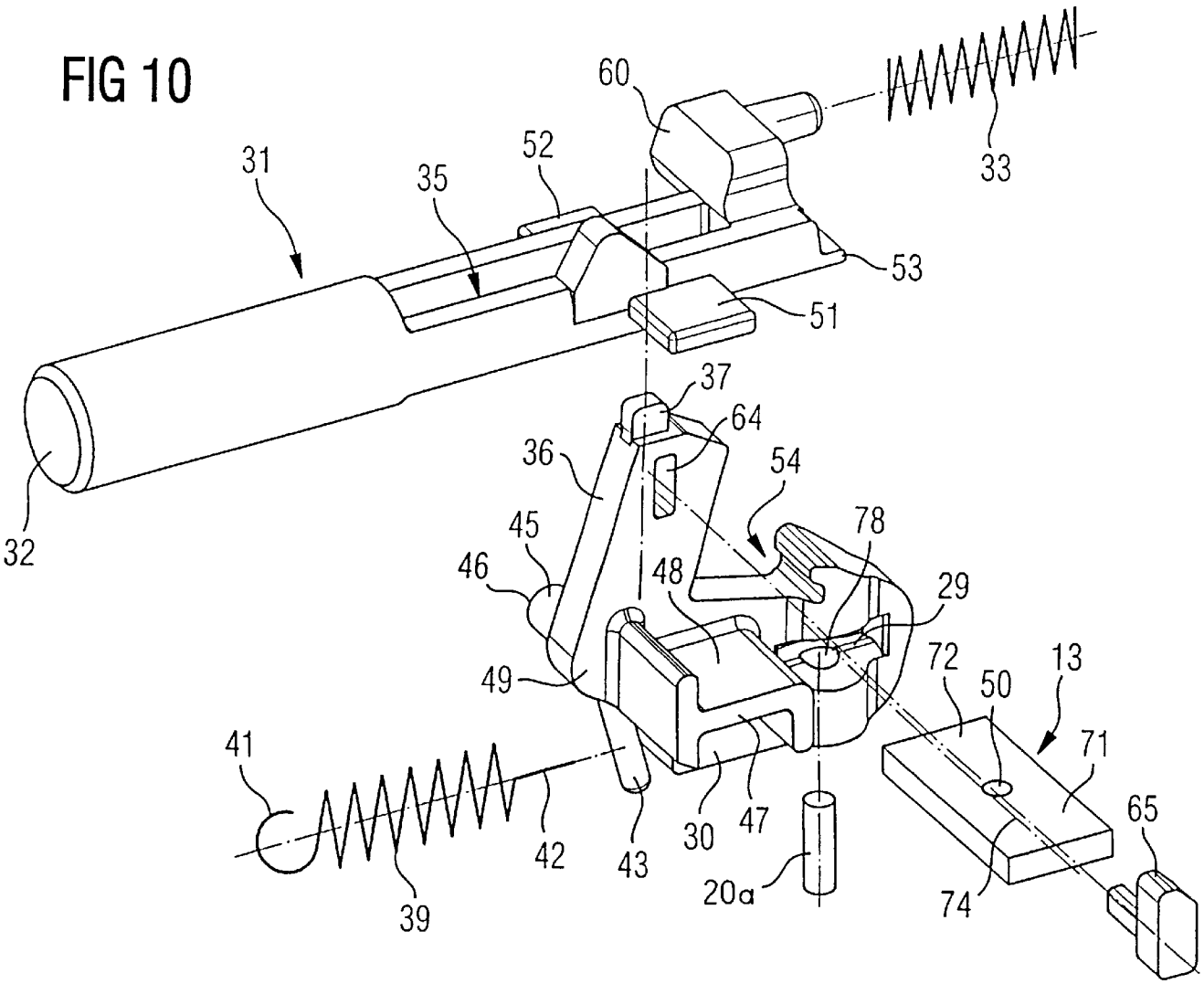
FIG. 10 is an enlarged view corresponding to FIG. 5 with a supplemental part, with which the overcurrent switch can also be turned off manually without any problems.

FIGS. 10 and 11 show a simple option of designing the above-described switch such that it can also be released manually. This manual release simply occurs in that the switch rod 31 is pushed further into the housing 1 in actuation direction 34, past the switched-on position (FIG. 9) and counter to the reaction pressure of the two springs 33, 39. As a result, the movement sequence of an overcurrent release is simulated mechanically. To permit this, the end of the horizontal leg 36 of contact bridge support 20 that is adjacent to the interlocking cam 37 is provided with an insertion slot 64 for securing the release cam 65, which rests against the bimetal 38 during the switched-on position. When the switch rod 31 (FIG. 11) is pushed past the switched-on position (FIG. 9), the bimetal 38 is mechanically bent outward in clockwise direction and thus disengages the locking connection between the interlocking cam 37 and the detent opening 55. As a result of this, the contact bridge support 20 is freed to move in opening direction under the effect of the two springs 33, 39.

The figures illustrate the simple installation option of the switch: Initially, the component VI that is assigned to the fixed contact 15 of the current leakage is inserted in accordance with FIG. 6 into the chassis section 2. Subsequently, the component V (FIG. 4) that comprises the contact bridge support 20 with threaded-on switch rod 31 is also mounted on the chassis section 2 while the function springs 33, 39 are anchored at the same time. Following this, the fixed contact 14 that is assigned to the current input is fixed securely on the chassis section 2. This ensures at least for the duration of the installation operation that the components previously attached to the chassis section 2 are held such that they cannot detach themselves.

The chassis section 2 is then placed in the position relative to the locking section 3, which is shown in FIGS. 2 and 3. The chassis section 2 is subsequently pushed like a drawer into the locking section 3, counter to the pressure direction 34 of switch rod 31. In this case, the flank walls 11, 12 of closing part 3 grip behind the side wall 4 in the manner of a dovetail by means of their projecting fins 66, 67. In the pushed-in position, the chassis section 2 engages into the locking section 3 in that its locking projections 68 fall into the locking recesses 69 of the locking section 3.

A threaded sleeve 70 that protects outward is formed onto the front wall 10 of locking section 3 and serves to fasten the switch, e.g. in a switching cabinet.

It will be understood that the above description of the preferred embodiment of the present invention is susceptible to various modifications, changes and adaptions, besides those already described, and the same are intended to be comprehended within the meaning and range of equivalents of the appended claims.

What is claimed is:

1. An overcurrent circuit breaker switch having a flat, approximately block shaped housing made of insulating material with first and second front walls and side walls that extend approximately parallel to each other, and a switch gear located between the parallel side walls and having a movement plane in which components of the switch gear move that extends approximately parallel to the side walls of the housing, the first front wall having a bushing for contact connections and the second front wall having a bushing for a device for manual actuation of the switch gear, said switch comprising:

a contact bridge support made of insulating material, said contact bridge support being a component of the switch gear;

two fixed contacts, each having a narrow edge and a flat piece with a longitudinal axis which extends away from said first front wall into an interior of the housing, said two fixed contacts being spaced from one another and being positioned so that said contact bridge support projects into the space between said two fixed contacts; and a contact bridge movable between an on position and an off position, said contact bridge being held inside the contact bridge support and having a longitudinal axis that extends in a bridging direction which aligns approximately at a right angle to the movement plane for the switch gear, said contact bridge having contact ends that project on both sides over said contact bridge support in the direction of the side walls of the housing, wherein said fixed contacts are flat pieces that are aligned in the manner of a knife blade, are each positioned with a flat side approximately parallel to the side walls, and form respectively one contact point with a side of the narrow edge facing said contact bridge, the contact points being parallel to one another, the other side of the narrow edge of the fixed contacts facing and fitting flush against a flank wall of the housing.

2. A switch according to claim 1, wherein each said fixed contact has an end at the first front wall which is bent in a direction toward the interior of the housing to assume an approximately parallel position to the first front wall of the housing in order to form a base element, a flat piece of one of said fixed contacts being flush with one of the side walls of the housing, the base elements being positioned on holding projections that project from a side wall into the interior of the housing near the first front end of the housing.

3. A switch according to claim 2, wherein base elements of the fixed contacts are positioned at different distances from the first front walls and said flat pieces of said fixed contacts are of varying lengths.

4. A switch according to claim 2, wherein the base elements form an upper U-shaped leg of a U-shaped pedestal part for the fixed contacts, said pedestal parts embrace a respective one of the holding projections with their U-shaped legs.

5. A switch according to claim 1, wherein in the on position of the circuit breaker, the contact bridge support projects into the space between said two fixed contacts with a flat, support piece that functions as a separating wall.

6. A switch according to claim 1, further comprising:

a switch rod made of insulating material which serves as the device for the manual actuation of the switch gear, said switch rod having an actuation end which projects from said second front wall and a longitudinal groove which extends approximately in the center of the movement plane for switch gear kinematics, receives said contact bridge support therethrough and serves as a sliding guide for said contact support bridge;

a release spring located in the housing and spaced from the two fixed contacts, said switch rod movable in an axial direction counter to an opposing force of said release spring in the movement plane for switch gear kinematics that extends in the space between the two fixed contacts; and an overcurrent release located in the housing approximately parallel to the flank wall of the housing and spaced from the fixed contacts, the movement plane for switch gear kinematics being arranged between the fixed contacts and the overcurrent release, wherein manual actuation of the switch rod causes said contact bridge support to interlock with said overcurrent release counter to the opposing force of said release spring and causes the contact bridge which extends on both sides of the contact bridge support to move and establish a contact connection with said two fixed contacts.

7. A switch according to claim 1, wherein said contact bridge support has an angular design with an interlocking leg and a vertical leg which projects toward the fixed contacts approximately in the direction of manual actuation of the switch gear, said vertical leg having a free end that holds said contact bridge.

8. A switch according to claim 7, wherein said contact bridge is a sheet metal piece that is one of bare, electroplated, plated, and provided with contact plates and forms a contact on both ends of the metal piece, said contact bridge being inserted into an approximately perpendicular slot of the vertical leg and being capable of being deflected slightly on both ends around an axis of the slot from the approximately perpendicular position to said contact bridge support.

9. A switch according to claim 6, further comprising a tension spring on the fixed contacts side of the housing wherein said contact bridge support is held toward the second front side of the housing by said tension spring.

10. A switch according to claim 9, wherein the housing includes a chassis section and a locking section, the chassis section has a side all and the first front wall, and the locking section has a side wall, two flank walls and the second front wall, and wherein said tension spring at its upper end is threaded onto a holding protrusion that projects upward from the side wall of the chassis section.

11. A switch according to claim 10, wherein, the holding protrusion extends to the side wall of the locking section when the chassis section is inserted into the locking section.

12. A switch according to claim 6, wherein the housing includes a chassis section and a locking section, the chassis section has a side wall and the first front wall, and the locking section has a side wall, two flank walls and the second front wall, and wherein said switch rod and said contact bridge support are guided inside the housing so that they can move aligned in the movement plane by fitting against the side walls of the chassis section and the locking section.

13. A switch according to claim 9, wherein the lower end of said tension spring is threaded onto a holding finger attached to the side of the contact bridge support that is located opposite the contact bridge side that interlocks with said overcurrent release.

14. A switch according to claim 9, wherein the housing includes a chassis section and a locking section, the chassis section has a side wall and the first front wall, and the locking section has a side wall, two flank walls and the second front wall, and wherein said tension spring extends and is secured outside of the center of the movement plane for the switch gear kinematics, in a region close to the side wall of the chassis section.

15. A switch according to claim 9, wherein the housing includes a chassis section and a locking section, the chassis section has a side wall and the first front wall, and the locking section has a side wall, two flank walls and the second front wall, and further comprising a turning and sliding joint guide located on the fixed contacts side of the housing between said switch rod and said tension spring, said turning and sliding joint guide being essentially oriented in the actuation direction and guiding said contact bridge support on the side wall of the chassis section.

16. A switch according to claim 15, wherein said turning and sliding joint guide includes a guide groove on the side wall of said chassis section, said guide groove extends essentially parallel to said switch rod, and a pivot movably guided in the guide groove, said groove being aligned approximately perpendicularly to the movement plane for the switch gear kinematics.

17. A switch according to claim 16, wherein said guide groove has an approximately circular-arc segment shaped course with a curvature bulge that faces said switch rod.

18. A switch according to claim 1, wherein the housing includes a chassis section and a locking section, the chassis section has a side wall and the first front wall, and the locking section has a side wall, two flank walls and the second front wall, and wherein said contact bridge support has a fin-type bracket extending from the contact bridge support and together with said bracket fits as an alignment and guide surface against the side wall of the locking section.

19. A switch according to claim 1, wherein said fin-type bracket extends from a vertex region between two legs of said contact bridge support into a region where said contact bridge is held.

20. A switch according to claim 6, further comprising two guide shoes which project diametrically in an approximately perpendicular direction to the movement plane and between which said switch rod is guided such that it can be displaced in the actuation direction through the second front wall bushing without turning.

21. A switch according to claim 20, wherein the guide shoes flank the longitudinal groove for the switch rod.

22. A switch according to claim 7, further comprising a gripping fin at the lower end of said switch rod, said gripping fin being installed as carrier on the vertical leg of the contact bridge.

23. A switch according to claim 22, further comprising a carrier notch arranged on the contact bridge support and projecting during the open position of the contacts into a movement path of the gripping fin and wherein when said switch rod is manually actuated, the gripping fin is installed in the carrier notch causing the contact bridge support to move and the interlocking leg of the contact bridge support interlocks with the overcurrent release.

24. A switch according to claim 6, wherein the overcurrent release has a bimetal which is arranged approximately parallel to said switch rod, the bimetal having a detent opening on a swing-out end, and wherein said contact bridge support has an angular design with an interlocking leg and a vertical leg, the interlocking leg having a cam at its outer end which engages the detent opening of said overcurrent release to interlock.

25. A switch according to claim 1, further comprising a U-shaped bimetal serving as an overcurrent release, said bimetal being supported by a fixed contact with a U-shaped leg end that points downward, and being capable of being swiveled away from the contact bridge support under the effect of an overcurrent and in order to release the contact bridge support from an interlocking end formed by a U-shaped arc.

26. A switch according to claim 24, wherein the interlocking cam of the contact bridge support is flanked by an attached release cam, which permits a manual release of the switch by simulating an overcurrent release if the switch rod is pushed past the switch-on and stop position of the contact bridge support.

27. A switch according to claim 1, wherein wherein the housing includes a chassis section and a locking section, the chassis section has a side wall and the first front wall, and the locking section has a side wall, two flank walls and the second front wall, and wherein said fixed contacts and other components of the switch gear are arranged in the chassis section which is insertable into the locking section in the manner of a drawer counter to the actuation direction said switch rod, said chassis section being secured in the inserted position in which the locking section with its side wall, two flank walls and second front wall close off an open side of the chassis section, the flank walls of the locking section embracing opposite flanks of the chassis section.

* * * * *